US009295606B2

(12) United States Patent
Flythe, Jr.

(10) Patent No.: US 9,295,606 B2
(45) Date of Patent: Mar. 29, 2016

(54) GAIT TRAINING SYSTEM

(76) Inventor: Jimmie Flythe, Jr., Highland Village, TX (US)

( * ) Notice: Subject to any disclaimer, the term of this patent is extended or adjusted under 35 U.S.C. 154(b) by 446 days.

(21) Appl. No.: 13/360,671

(22) Filed: Jan. 28, 2012

(65) Prior Publication Data

US 2013/0197407 A1 Aug. 1, 2013

(51) Int. Cl.

| | |
|---|---|
| ***A61H 3/00*** | (2006.01) |
| ***A61H 1/02*** | (2006.01) |
| ***A61H 3/04*** | (2006.01) |
| *A63C 17/01* | (2006.01) |

(52) U.S. Cl.

CPC ..... *A61H 1/0262* (2013.01); *A61H 3/00* (2013.01); *A61H 3/04* (2013.01); *A61H 2003/046* (2013.01); *A61H 2201/0173* (2013.01); *A61H 2201/0176* (2013.01); *A61H 2201/0192* (2013.01); *A61H 2201/1253* (2013.01); *A61H 2201/1261* (2013.01); *A61H 2201/1269* (2013.01); *A61H 2201/1284* (2013.01); *A61H 2201/165* (2013.01); *A61H 2201/1642* (2013.01); *A63C 17/01* (2013.01)

(58) Field of Classification Search

CPC ..... A61H 1/0266; A61H 23/0254; A61H 1/0214; A61H 1/0259; A61H 1/0237; A61H 1/02; A61H 2201/1269; A61H 2201/1253; A61H 2201/1261; A61H 2201/1284; A61H 2201/0176; B23Q 3/15773; B23Q 3/15546; B23Q 3/15766; B23Q 3/15526; B25J 15/04; A63C 17/01; B62K 3/002; A63B 23/0464; B62B 5/04; B62B 9/08; B61H 7/02; B60T 1/14

USPC ..... 601/23, 24, 27, 30, 32, 33, 34, 35; 280/87.042, 87.041; 434/255; 188/5, 188/19, 20, 36, 2 F; 482/8, 9, 51, 66, 68, 69

See application file for complete search history.

(56) References Cited

U.S. PATENT DOCUMENTS

| | | | | |
|---|---|---|---|---|
| 3,112,119 | A * | 11/1963 | Sweet | 280/11.209 |
| 3,231,050 | A * | 1/1966 | Belyeu | B62B 5/049 188/5 |
| 3,350,095 | A * | 10/1967 | Clasen | 482/68 |
| 3,794,037 | A * | 2/1974 | Matteson | 36/156 |
| 3,805,773 | A * | 4/1974 | Sichau | 602/28 |
| 4,043,566 | A * | 8/1977 | Johnson | A63C 17/01 188/5 |
| 4,054,296 | A * | 10/1977 | Sullins | A63C 17/01 188/5 |
| 4,168,076 | A * | 9/1979 | Johnson | A63C 17/01 188/5 |
| 4,394,028 | A * | 7/1983 | Wheelwright | A63C 17/1409 280/11.19 |
| 5,732,964 | A * | 3/1998 | Durham et al. | 280/266 |
| 5,826,350 | A * | 10/1998 | Wallerstein | 36/7.8 |
| 6,874,795 | B2 * | 4/2005 | Sung | 280/11.223 |
| 6,905,127 | B2 * | 6/2005 | Lester | 280/11.28 |
| 7,673,641 | B2 * | 3/2010 | Karasin et al. | 135/85 |

(Continued)

OTHER PUBLICATIONS

Dr. Med. Axel Ruetz, Therapeutic Application and Gait Training, Otto Bock Quality of Life, Dec. 2008, p. 21, p. 24, and p. 26.*

*Primary Examiner* — Justine Yu
*Assistant Examiner* — Tu Vo
(74) *Attorney, Agent, or Firm* — Jeffrey Roddy

(57) ABSTRACT

A system for gait training which includes a height-adjustable rolling platform for attaching to the foot with or without a shoe, on the affected side of a subject. When the subject shifts their body weight away from the affected side, the platform is capable of forward and backward movement to follow the swinging movement of the leg. When the subject shifts their body weight to the affected side, a passive braking system arrests any further movement of the affected limb.

9 Claims, 5 Drawing Sheets

(56) References Cited

U.S. PATENT DOCUMENTS

2004/0198564 A1* 10/2004 Takizawa et al. ..... 482/68
2008/0034617 A1* 2/2008 Anderson ..... 36/116
2008/0119765 A1* 5/2008 Meckel et al. ..... 601/34
2008/0122193 A1* 5/2008 Ferguson ..... 280/87.041

* cited by examiner

FIG. 4
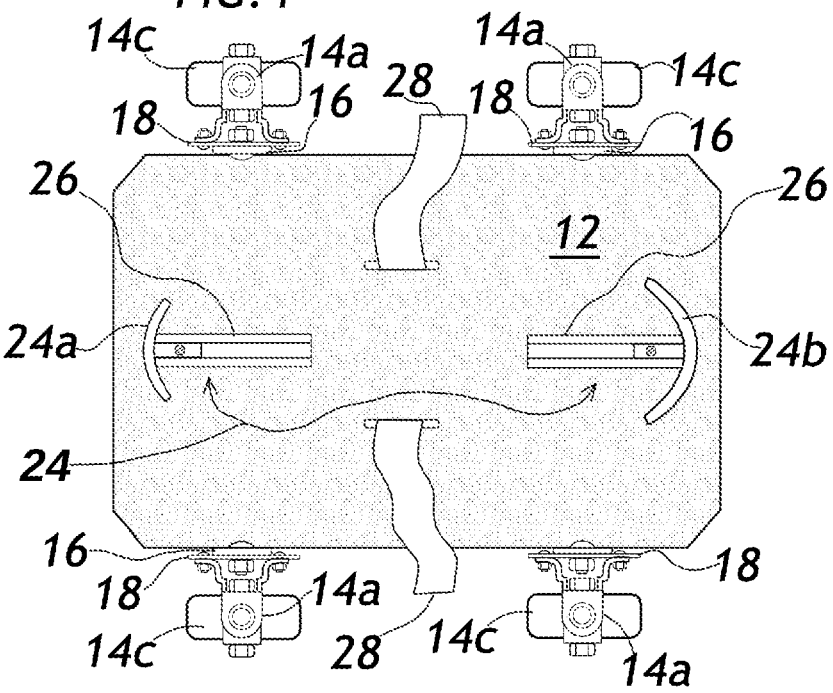
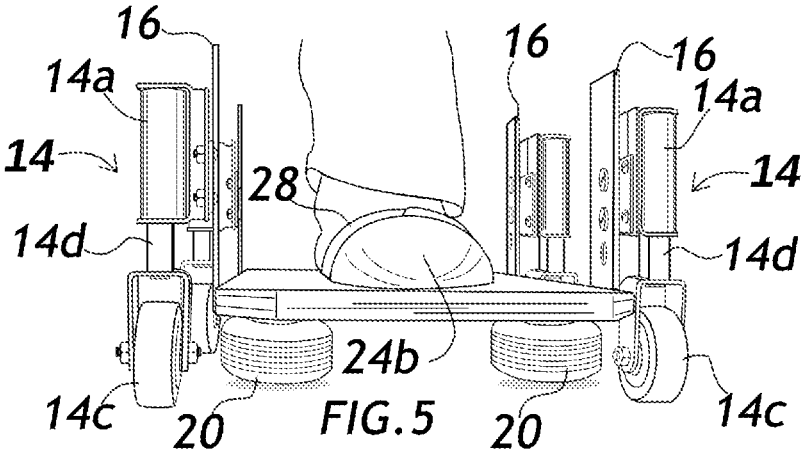
FIG. 5

GAIT TRAINING SYSTEM

FIELD OF THE INVENTION

The present invention relates generally to a system for assisting subjects with impaired mobility in regaining, to the extent possible, a natural gait.

BACKGROUND OF THE INVENTION

Gait is defined as the manner or style of walking. Gait Analysis refers to the evaluation of certain gait characteristics. The normal forward step consists of two phases: the stance phase in which one leg and foot are bearing most or all of the body weight, and the swing phase in which the foot is not touching the walking surface and the body weight is supported by the other leg and foot. In a complete two-step cycle, that portion of time that both feet are in contact with the floor; about 25% of the time, is called the double-support phase.

Many individuals suffer from various conditions that do not allow the advancement of a limb because of weakness or lack of motor control which causes disturbances to the normal gait pattern. One such condition causing disruptions to the normal gait pattern is hemiparesis, which is characterized by weakness on one side of the body. As many as 88% of subjects with acute stroke have hemiparesis. Physical therapists work with stroke subjects to improve awareness and use of the affected side. Current practice is to initiate physical therapy (PT) as soon as practicable after the stroke because the adaptive ability of the brain to compensate with regard to the locomotor system diminishes over time. PT involves exercises to increase range of motion and strength, and retrain motor skills such as bed mobility, transferring, walking and other gross motor functions. Retraining often utilizes assistive devices such as walkers, canes and occasionally, orthotics. Although gait training seeks to regain as much of the subject's premorbid leg mobility as possible, current assistive devices can discourage or actively prevent the use of certain motor groups of the lower extremities (LE) which would otherwise be useful in normalizing gait patterns. Because current gait training devices isolate certain muscular groups. one of the major drawbacks is that maladaptive gait habits may be inadvertently reinforced by such devices.

It would be desirable to provide a gait training system and method for gait challenged subjects regardless of etiology, that safely encourages the use of all relevant muscular groups under the supervision of a physical therapist so as to avoid compromising the subject's ability to normalize their gate.

It would be desirable for such a system and method to naturally integrate with the subject's own movements of lifting a foot, moving the leg forward or backward, and setting the foot down again to arrest forward motion.

It would be additionally desirable for such as system and method to be used independently of clinical supervision once the subject is physically capable of the transition.

SUMMARY OF THE INVENTION

The present invention assists with swing motion training and advancement of the affected limb until the leg is sufficiently strong and coordinated to enable normal lift and swing while walking, and includes an apparatus having a (1) a rolling platform, (2) a height adjustment means and (3) passive braking functionality, which means that the braking is experienced by the subject without active or concerted effort; (i.e., automatically). The system also includes a method for using the apparatus in a clinical setting. The rolling platform is generally flat, being constructed of any material, such as metal, wood, plastic, composite, or any combination of the foregoing, sufficient to support the weight of a human being. In the particular embodiment described herein, the rolling means is comprised of four spring suspension caster assemblies, similar to ladder casters. Each assembly has a wheel mounted to a fork, with the fork having a projecting member directly above and perpendicular the wheel. The projecting member extends into a cylinder and is surrounded by a coiled spring (not shown) inside the cylinder which acts similarly to a shock absorber, so when the platform is placed on a surface, the cylinder and the wheel are caused by force perpendicular to the surface bearing down on the platform, to compress together. A portion of the cylinder is joined to a flange which is mounted to a vertical post via a height adjustment plate. The vertical posts are secured to the edges of the platform by fastening using any suitable means. Platform height adjustment is accomplished by raising or lowering the caster assemblies in relationship to the posts by loosening and re-affixing the height adjustment plates which varies the distance of the platform to the ground. It should be understood that the particular embodiment described is not to be limited to the particular type of caster assembly shown, but to any wheeled assembly with suspension means as would suggest itself to a person having skill in the art and the benefit of this disclosure. Accordingly, pneumatic, hydraulic, rubber disks, leaf springs, and other known types of suspension are considered to be encompassed by this disclosure. Contributing to passive braking functionality, the bottom facing side of the platform includes anti-skid means which are shown in the preferred embodiment as a set of cylindrical rubber bumpers mounted to the bottom side of the platform, but can be any sufficiently skid resistant material such as molded rubber forms or textured rubber sheeting or foam rubber affixed to the bottom side.

In one exemplary use of the invention, a physical therapist first adjusts the height of the platform which in the fully down position with the braking means in contact with a floor surface, is adjusted to correspond the sole thickness of a shoe or spacer worn on the unaffected side. The therapist then assists the subject to a standing position in which the foot on the affected side is placed on top of the platform and secured thereto by straps. With the assistance of the therapist, forward ambulation, and optionally backward ambulation: as for example, to assist a subject in backing into a seated position, is accomplished by the subject (1) shifting body weight away from the affected side and (2) swinging the affected leg in the desired direction and then (3) shifting the weight back to the affected side. When weight is initially shifted away from the affected side, the platform is forced to rise slightly by the spring casters which separates the bumpers from the floor and allows the platform to roll freely forward or backward. While the casters shown in the preferred embodiment are preferably constrained to roll in a generally linear direction forward or backward, other casters with spring suspension can have 360° of wheel rotation with the option to secure the caster for linear movement. When weight is shifted to the affected side, the platform depresses, forcing the bumpers into contact with the floor where they serve to arrest any rolling platform movement. One important aspect of the passive braking is obviating the requirement for an overly complex mechanism to arrest motion. Moreover, the weight actuated braking of the instant invention is close to that of normal ambulation in which body weight is naturally alternated from side-to-side. Among other salient aspects of the invention which will become apparent to persons of skill in the art having benefit of this disclosure is the encouragement of use of a greater range of LE muscles than other gait training tools. Another salient aspect of the invention is that braking is actuated without conscious effort, being the result of the shift of weight which naturally occurs during a gait cycle.

One object of the present invention is to provide a system of gait training which encourages the use of both major and minor muscle groups associated with the LE.

Another object of the present invention is to provide a system of gait training which includes both forward and backward movement of an affected leg while performing gait training exercises.

Yet another object of the present invention is provide a gait training apparatus with a passive braking means that mimics the natural tendency of a leg to cease movement when weight is shifted thereto.

Still another object of the present invention is to provide a safe gait training method that may be practiced with or without the physical support of the therapist.

The description as follows is not intended to limit the scope of the invention to the particular forms set forth, but on the contrary, it is intended to cover such alternatives, modifications, combinations and equivalents as may be included within the spirit and scope of the invention as set forth in the detailed description.

BRIEF DESCRIPTION OF THE DRAWINGS

FIG. 4 is a top plan view of a preferred embodiment according to the present invention;

FIG. 5 is a perspective view of a preferred embodiment in typical use in a mobilized position according to the present invention;

DETAILED DESCRIPTION OF THE INVENTION

Reference Listing

Figure 1:
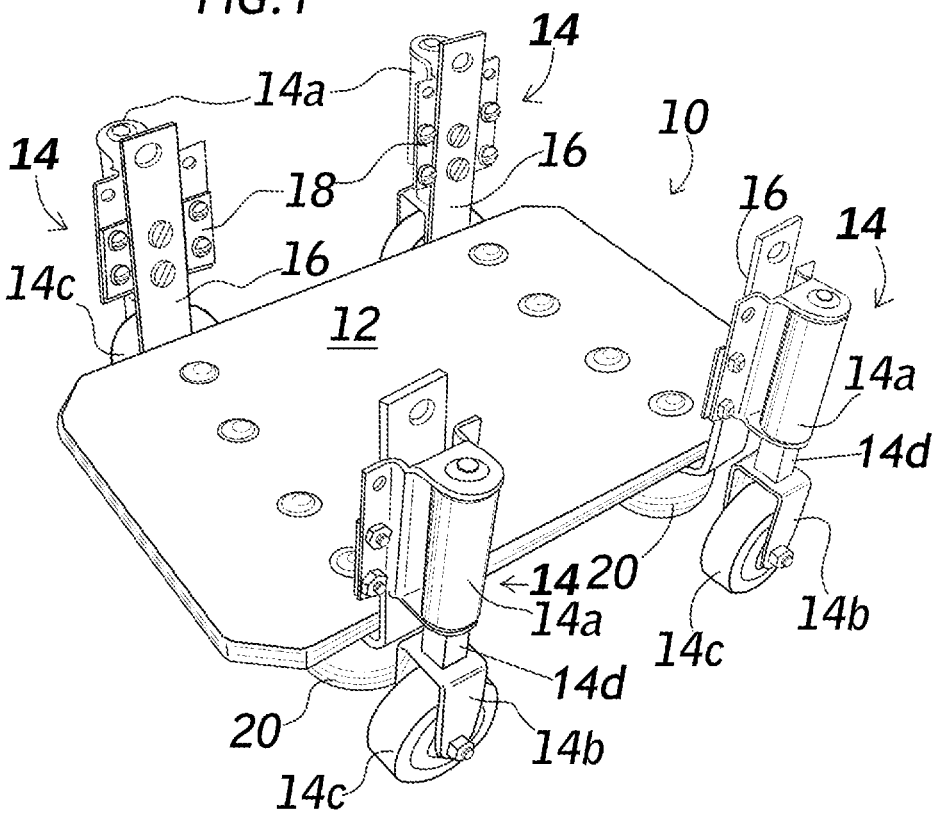
FIG. 1 is a top perspective view of a preferred embodiment according to the present invention.
Figure 2:
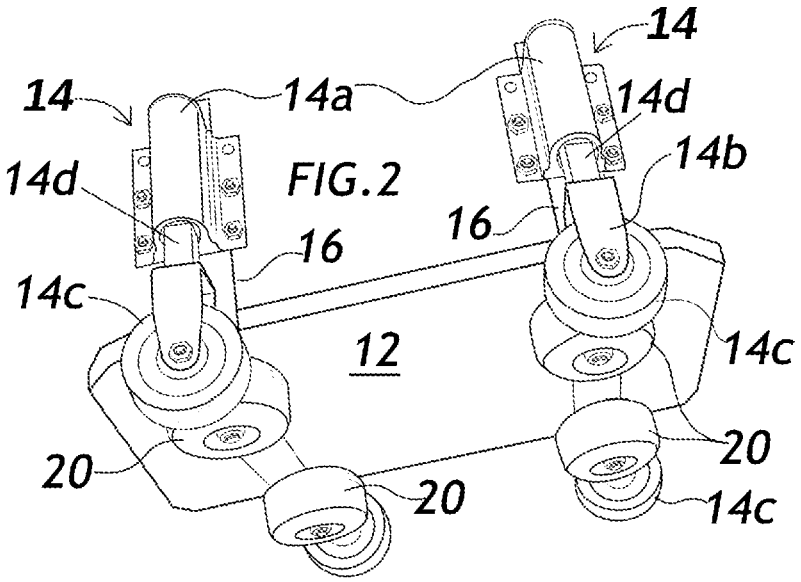
FIG. 2 is a bottom perspective view of a preferred embodiment according to the present invention.
Figure 3:
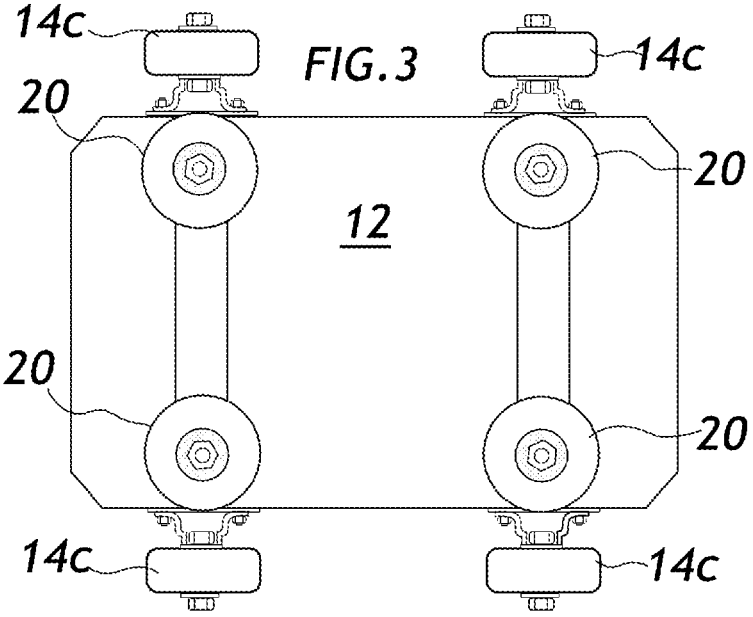
FIG. 3 is a bottom plan view of a preferred embodiment according to the present invention.

10 gait assist
12 platform
14 spring caster assembly
14*a* caster cylinder
14*b* wheel fork
14*c* wheel
14*d* fork post
16 post
18 height adjustment plate
20 braking bumper
21 contacting point
22 braking pad
24 foot frame
24*a* heel cup
24*b* toe cup
26 groove
28 strap Definitions In the following description, the term involved limb refers to a weak leg, while the term uninvolved limb refers to an unaffected limb. The term gait belt refers to an over-sized strap that is wrapped about a subject's waist and secured by a buckle which is used to guide and support a subject during gait training. The term gait cycle refers to cyclic movement which includes at least two phases; the stance phase, and the swing phase. Stance phase is the lower extremity supporting the body weight as the swinging extremity passes through to progress the step forward for contact weight acceptance of the swinging limb. The cycle is then repeated. The term gait training stance refers to a stance assumed by a gait trainer or physical therapist to the side of a subject undergoing gait training, in which one of the trainer's feet is maintained ahead of the moving subject, while the other is maintained behind the subject to facilitate repeated gait cycles. The term spacer refers to any kind of member; typically a sole-shaped element that may be provided in a number of thicknesses, and affixed to the bottom of a foot or shoe worn on the unaffected side to extend leg length.

Referring generally to FIGS. 1-8, a gait training apparatus includes a platform 12 having a rolling means which in the preferred embodiment shown, includes four caster assemblies 14 mounted to the platform via posts 16. The caster assemblies each have a wheel 14*c*, a fork 14*b* and a fork post 14*d*. The fork post is partially shrouded by a cylindrical drum 14*a* with attached flange. The drum encloses a coil spring (not shown), circumjacent the shrouded portion of the fork post which provides suspension for the caster, allowing the fork post to plunge in an out of the cylinder. The platform depresses toward the floor when weight is applied thereto, and rises when the weight is shifted away from the apparatus.

At least one anti-skid element is attached to the under surface of the platform 12 facing the floor when in use, and contributes to the passive braking that terminates the natural motion of a swinging leg. Although, the anti-skid element shown in the embodiment is a rubber bumper 20, it can be any object having non-skid characteristics, or a material such as textured rubber sheeting applied directly to the bottom surface of the platform which provides friction resistance to platform movement when the platform is depressed and the anti-skid element in is contact with the floor.

Height adjustment of platform 12 is accomplished by readjusting the position of the caster assemblies 14 mounted to posts 16, by (1) removing bolts that pass through posts 16 and height adjustment plates 18 which are also affixed to the flange portion of the caster cylinder 14*a*, and (2) repositioning plates 18 to align with apertures on post 16, and (3) reinserting the bolts to reattach the plates to the new position. It is intended that any height readjustment result in a platform substantially parallel with the floor. While the height adjustment means shown in the preferred embodiment allows a discrete number of height positions in relation to the floor corresponding to the number of apertures on post 16, it should be understood that other relatively simple mechanisms and substitutes for the bolts; as for example, various re-insertable pins, will suggest themselves to those having skill in the art, and accordingly, are intended to be encompassed by the invention.

The platform in the preferred embodiment has a non-skid rubberized and adhesive-backed material adhered to the top surface to prevent foot slippage. In addition, FIG. 4 shows re-sizable frame 24 intended to be used with a shoe placed therein. The frame includes heel 24*a* and toe cups 24*b* which are slidable within grooves 26 in order to size, cradle and center the foot upon the platform. A pair of straps 28 with ends having hook and loop fasteners are attached to the platform for securing the foot with shoe onto the platform.

Figure 6:
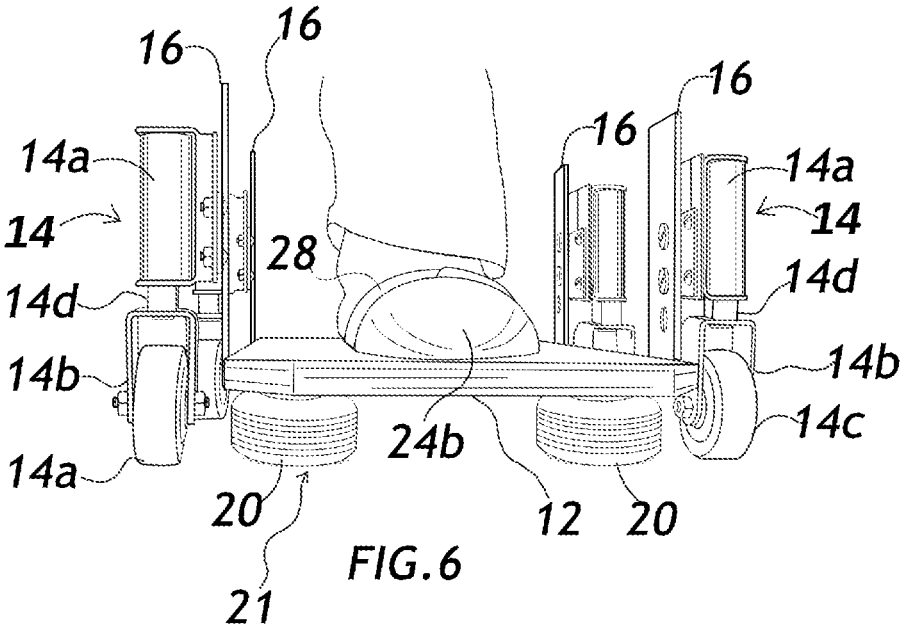
FIG. 6 is a perspective view of a preferred embodiment according to the present invention, in typical use in an immobilized position with the fork posts 14*d* forced into the caster cylinders 14*a* and bumpers 20 contacting the floor surface.
Figure 7:
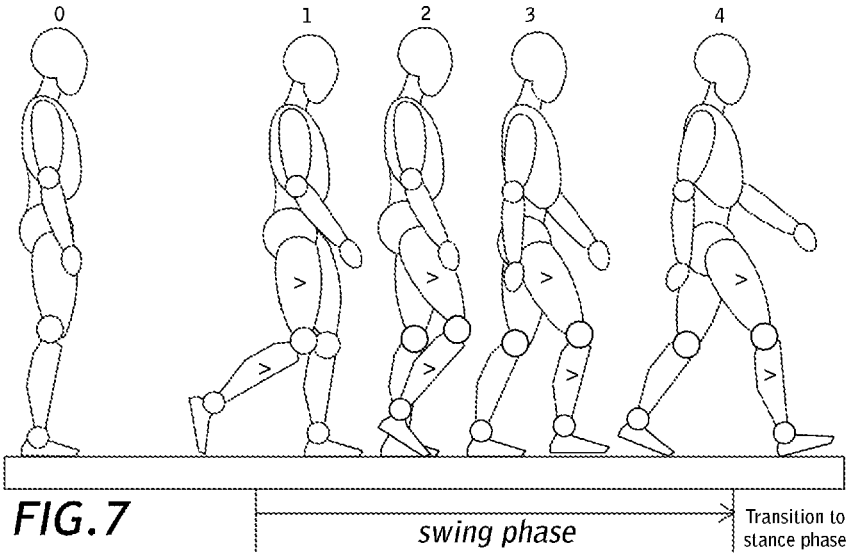
FIG. 7 is diagrammatic view a swing phase of an unaffected limb (denoted by >), during a gait cycle.

FIG. 5 depicts the gait trainer in a typical use with a foot cradled by and held securely to the platform. The platform depicted is in a free rolling position with the bumpers separated from the floor. FIG. 6 depicts the apparatus in a typical use in which a wearer's body weight has been shifted to the platform, the fork posts 14*d* are forced further inside the caster cylinders 14*a*, and the platform is thereby lowered, placing bumpers 20 in contact with the floor surface and braking the platform movement.

The apparatus can be donned independently by a subject with the assistance of a physical therapist or a family member. While the apparatus will fit to subject's foot with or without a shoe, most preferably, the subject wears a shoe on the foot belonging to the involved leg, which is inserted into re-sizable frame 24. The heel 24*a* and toe 24*b* cups are then repositioned to securely embrace and substantially center the subject's foot on the platform. Although as shown FIG. 1, the gait trainer can be used without frame 24, the subject will have an optimal sense of contact with frame cradling a foot with or without a foot covering.

Because the platform has spring suspension, this offers some resistance to depressing during the arc of the swing phase, giving the subject a sense of support beneath the involved limb. Accordingly, what follows is intended to be an exemplary, non-limiting description of the invention's use.

Example of Use with the Assistance of a Trainer (I) Standing

With or without assistance, a subject dons a shoe on both feet. The foot belonging to the subject's involved leg is secured into the re-sizable frame if present, or otherwise strapped to the center top of the platform. Height adjustments are made to the platform which can optionally include an attachable spacer affixed to the bottom of the shoe worn on the subject's unaffected side in order for the subject to maintain a level stance. The subject is then assisted to stand by grasping the subject's waist belt or using a gait belt.

(II) Walking

Figure 8:
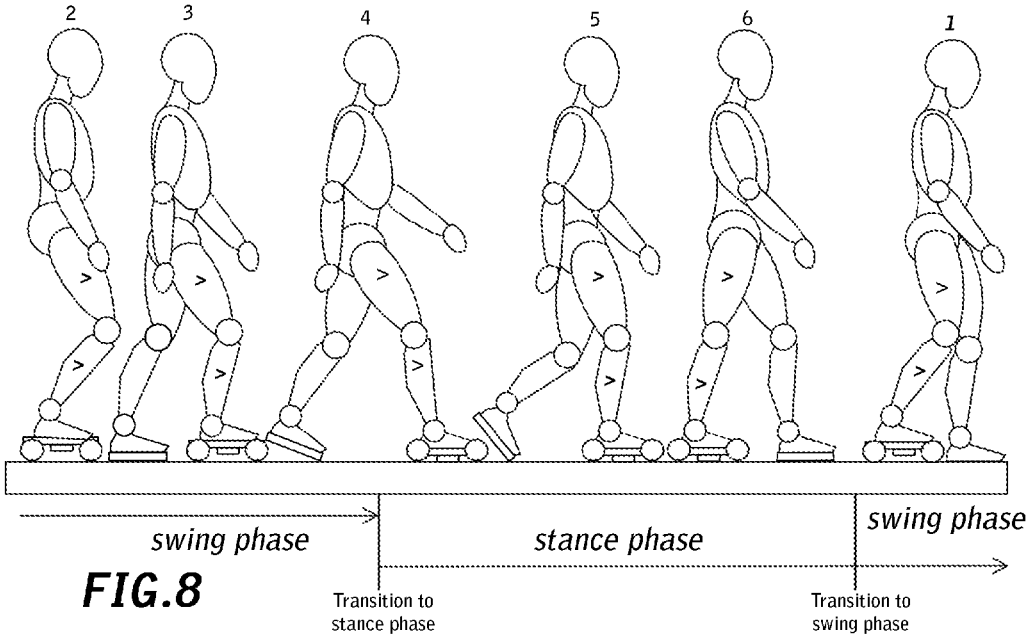
FIG. 8 is a diagrammatic view of the modified swing phase of an affected limb (denoted by >), wearing one embodiment of the present invention.

Once the subject is standing, weight is shifted to the uninvolved limb for support. In preparation for gait training, the trainer maintains a stance to the side of the subject in which one of the trainer's feet is in front of the subject. while the other foot is positioned behind the subject while maintaining contact with the gait belt, allowing the trainer to support the subject where needed through repeated gait cycles. As shown in FIG. 8 (2-6), when the subject swings/rolls the involved limb forward, the platform slightly lifts FIG. 8 (2-3), allowing the involved limb to be advanced. The trainer can assist the subject's pelvic rotation by guiding the subject via the gait belt (not shown) as required. The trainer constantly repositions himself according to the subject's movement while giving verbal instruction if required. Once the step of the involved limb completes, the trainer assists in shifting weight to the involved leg. As the weight is shifted, the platform of the invention accepts the weight, the springs compress FIG. 8 (4-5), and the platform is lowered until the bumpers are forced into contact with the floor FIG. 6 (21) terminating any further movement. The involved leg becomes the stance leg FIG. 8 (6) and awaits the subject's weight shift to the uninvolved leg, and a repeat of the gait cycle as shown in FIG. 8 (1). If the subject requires bracing of the involved leg to prevent buckling, the trainer can block the subject's knee by using a hand held against the subject's knee, or the trainer's knee against the subject's knee. Once the swing phase of the involved leg is complete, the process is repeated until the uninvolved leg has once again transitioned to the stance leg.

Example of Use without Assistance (I) Standing

With or without assistance, a subject dons a shoe on both feet. The foot belonging to the subject's involved leg is secured into the re-sizable frame if present, or otherwise strapped to the center top of the platform. Height adjustments are made to the platform which can optionally include an attachable spacer affixed to the bottom of the shoe worn on the subject's unaffected side in order to compensate for the difference in leg length to enable the subject to maintain a level stance. The subject next brings themselves to a standing position that may be accomplished with the use of a hand rail, cane, walker, or other assistive device.

(II) Walking

Once the subject is in the standing position, they can shift their weight to the uninvolved leg defining the stance leg, and begin the process of swinging the involved leg forward. Initially, as weight shifts away from the involved leg, the platform rises slightly FIG. 8 (2-3), and permits the involved leg to swing/roll forward. As weight is shifted back to the involved leg, the leg is brought down, the platform depresses FIG. 8 (4), and the bumpers are forced into contact with the floor braking any platform movement. The involved leg is now the stance leg and the swing cycle can recommence with the uninvolved leg FIG. 8 (5). Once the uninvolved leg is fully in stance phase, the swing phase recommences with the involved leg as shown in FIG. 8 (1). In cases where the subject has a weak leg, and insufficient control of the knee, a leg brace can be supplied by a health practitioner to prevent the involved leg from buckling when weight is applied thereto.

While the invention has been described by the particular embodiments given, it is not intended that the scope of the invention be limited to the particular forms set forth. For example, other platform height adjustment means such as a rack and pinion system in which the post possesses a rack, and the caster assemblies are coupled with a element having a pinion which is interfacing with the post, and other types of raising or lower means are intended to fall within the claimed invention. Although the particular embodiment disclosed herein possesses anti-skid members that arrest the rolling motion of the platform, it is conceivable that other elements such as rubber pads or shoes extending from the platform which are forced against the wheels of the casters when the platform moves downwardly may be employed as a braking means. Also, while the platform of the particular embodiment is depicted as generally planar, it is conceivable that a platform may possess a central indentation for the placement of a foot therein, so as to bring the bottom of a foot; or the bottom of a worn shoe, in even closer communication with the floor. Accordingly, the invention is intended to cover such alternatives, modifications, and equivalents as may be included within the spirit and scope of the invention as defined by the appended claims.

What is claimed is:

1. A system for gait training and promoting a human gait cycle including portions of a stance phase and a swing phase for hemiparetic subjects, comprising:

(1) a roll-able height-adjustable platform capable of at least forward movement having a top side shaped and sized for placement and attachment thereto of plural sizes of a human foot belonging to an involved leg wherein the top side of the roll-able height-adjustable platform includes a foot contacting region delimited in area by bounds of a plantar aspect of a foot when placed thereon;

(2) a passive braking means activated by a cyclic shifting of the hemiparetic subject's body weight from a first side of the hemiparetic subject's body to a second side of the hemiparetic subject's body, in which at least one anti-skid member below the roll-able height-adjustable platform is configured to move automatically downward into contact with a floor surface to arrest the swing phase of the involved leg by immobilizing the roll-able height-adjustable platform whenever weight of the hemiparetic subject's involved leg is applied to the roll-able height-adjustable platform without requiring tilting of the roll-able height adjustable platform; and, (3) wheel assemblies attached to a periphery of the roll-able height-adjustable platform beyond the foot contacting region with portions of the wheel assemblies superior to the foot contacting region, and wherein height of the roll-able height-adjustable platform is adjusted by raising or lowering wheels.

2. The system according to claim 1 including a suspension system.

3. The system according to claim 1 in which the roll-able height-adjustable platform is capable of reverse movement.

4. A method for gait training hemiparetic subjects with a trainer, comprising the steps of:

(1) providing a gait training apparatus that includes at least a roll-able height-adjustable platform with a top side shaped and sized to accommodate plural sizes of a human foot and wherein the top side includes a foot contacting region delimited in area by bounds of a plantar aspect of the foot when placed thereon, and wherein the platform possesses passive braking means configured to automatically move downwardly for contact with a floor surface by the application of weight of an involved leg to the platform without requiring tilting of the roll-able height adjustable platform by the hemiparetic subject, (2) affixing a foot of an affected side of the subject to the smaller foot contacting region inside a periphery of the platform, (3) adjusting the maximum height of the platform from a floor surface as required by adjusting wheel assemblies attached to the platform periphery wherein some portions of the wheel assemblies are superior to the foot contacting region, (4) compensating for the length of an uninvolved leg as required to level the stance of the subject, (5) assisting the subject to his/her feet, (6) assuming a gait training stance relative to the subject, and, (7) assisting the subject in completing at least a portion of a gait cycle.

5. The method according to claim 4 in which the passive braking means comprises a anti-skid element below the roll-able height-adjustable platform which is brought into contact with a floor surface when weight is shifted to the roll-able height-adjustable platform.

6. The method according to claim 4 in which distance from the roll-able height-adjustable platform to a floor surface decreases when weight is shifted to the roll-able height-adjustable platform.

7. An apparatus for gait training and promoting a human gait cycle including portions of a stance phase and a swing phase for hemiparetic subjects, comprising:

(1) a roll-able height-adjustable platform capable of at least forward movement having a top side configured for placement and attachment thereto of plural sizes of a human foot belonging to an involved leg of a hemiparetic subject, wherein the top side of the roll-able height-adjustable platform includes a periphery, and on the platform inside the periphery, a substantially planar foot placement region for placement thereon of a sole of a foot;

(2) automatic braking means which includes at least one anti-skid member below the roll-able height-adjustable platform configured for automatic lowering into contact with a floor surface which immobilizes the roll-able height-adjustable platform whenever weight of a hemiparetic subject is applied to the platform without requiring tilting of the roll-able height adjustable platform; and, (3) wheel assemblies with suspension attached to the periphery of the roll-able height-adjustable platform with portions of the wheel assemblies superior to the foot placement section, and wherein height of the roll-able height-adjustable platform is adjusted by raising or lowering wheels.

8. The apparatus according to claim 7, wherein the anti-skid members are configured to automatically separate from the floor surface as weight of a hemiparetic subject is removed from the roll-able height-adjustable platform.

9. The apparatus according to claim 1, wherein the anti-skid members are configured to automatically separate from the floor surface as weight of a hemiparetic subject is removed from the roll-able height-adjustable platform.

* * * * *